US007162844B2

(12) United States Patent
Morrison et al.

(10) Patent No.: US 7,162,844 B2
(45) Date of Patent: Jan. 16, 2007

(54) USE OF PARTIAL PRECAST PANELS FOR CONSTRUCTION OF CONCRETE WALLS AND SHELLS

(75) Inventors: Donald MacKenzie Morrison, Hinsdale, IL (US); J. Ricky Simmons, Aurora, IL (US); David Roger Butts, Naperville, IL (US)

(73) Assignee: Chicago Bridge & Iron Company, Plainfield, IL (US)

( * ) Notice: Subject to any disclaimer, the term of this patent is extended or adjusted under 35 U.S.C. 154(b) by 5 days.

(21) Appl. No.: 10/339,098

(22) Filed: Jan. 9, 2003

(65) Prior Publication Data

US 2004/0134144 A1 Jul. 15, 2004

(51) Int. Cl.
*E04B 1/32* (2006.01)

(52) U.S. Cl. ..... 52/245; 52/745.09; 52/223.2; 52/249; 52/334; 52/745.1

(58) Field of Classification Search ..... 52/245, 52/247, 293.3, 506.02, 315, 381, 382, 192, 52/742.14, 747.12, 169.7, 168, 319, 334, 52/340, 296, 295, 193, 394, 745.1, 745.09, 52/249, 223.3

See application file for complete search history.

(56) References Cited

U.S. PATENT DOCUMENTS 2,270,297 A * 1/1942 Hensel ..... 52/506.03
3,833,944 A * 9/1974 Goettl et al. ..... 52/169.7
3,849,959 A * 11/1974 Lindner ..... 52/396.05
4,044,522 A * 8/1977 Sturmer et al. ..... 52/599
4,075,801 A * 2/1978 Alper et al. ..... 52/196
4,125,981 A * 11/1978 MacLeod et al. ..... 52/309.12
4,157,638 A * 6/1979 Della-Donna ..... 52/309.9
4,393,636 A * 7/1983 Rockstead et al. ..... 52/381
4,606,674 A * 8/1986 Capron ..... 405/224
4,625,478 A * 12/1986 Goode ..... 52/197
5,271,193 A * 12/1993 Olsen et al. ..... 52/19
5,398,472 A * 3/1995 Eichelkraut ..... 52/443
5,448,866 A * 9/1995 Saito et al. ..... 52/414
5,535,556 A * 7/1996 Hughes, Jr. ..... 52/169.5

(Continued)

FOREIGN PATENT DOCUMENTS

DE 295 07 704 U1 8/1995

(Continued)

OTHER PUBLICATIONS

Prestressed Concrete Institute brochure; vol. 20, No. 3, dated May/Jun. 1975.

(Continued)

*Primary Examiner*—Peter M. Cuomo
*Assistant Examiner*—Erika Garrett
(74) *Attorney, Agent, or Firm*—Marshall, Gerstein & Borun LLP

(57) ABSTRACT

A precast panel for building reinforced concrete walls has a metal liner that forms a front surface of the panel. A concrete mass is disposed behind the liner. The panel has reinforcement structure within the concrete mass that can be used to provide continuity of reinforcement between adjacent panels. Edges on the concrete mass are recessed, facilitating the connection of a splice end on a reinforcing bar with a splice end on an adjacent panel. The liner, reinforcement structure, and concrete mass form a composite steel-concrete structure.

5 Claims, 14 Drawing Sheets

U.S. PATENT DOCUMENTS 5,548,933 A * 8/1996 Sharma et al. ..... 52/192
5,590,497 A * 1/1997 Moore ..... 52/223.3
5,608,998 A * 3/1997 Hume ..... 52/245
5,673,528 A * 10/1997 Danisch et al. ..... 52/506.05
5,678,373 A * 10/1997 Franklin et al. ..... 52/439
5,791,107 A * 8/1998 Danisch et al. ..... 52/249
6,301,851 B1 * 10/2001 Matsubara ..... 52/430
6,360,496 B1 * 3/2002 Raccuglia ..... 52/169.1
6,546,679 B1 * 4/2003 Bushberger ..... 52/169.14

FOREIGN PATENT DOCUMENTS

NL 7115625 5/1973

OTHER PUBLICATIONS

Int'l search report in PCT/US03/40958 dated May 10, 2004.

* cited by examiner

USE OF PARTIAL PRECAST PANELS FOR CONSTRUCTION OF CONCRETE WALLS AND SHELLS

BACKGROUND OF THE INVENTION

The present invention relates generally to the construction of walls and shells, and particularly to the construction of reinforced concrete walls such as those used in liquid storage tanks.

Substances such as liquefied natural gas (LNG), ethylene, propane, and butane are often stored in full-containment, low-temperature or cryogenic storage tanks. Such tanks often include a reinforced concrete wall and a thin metal vapor barrier. In some cases, the vapor barrier is secured to the interior surface of a reinforced concrete wall.

At least one such storage tank was built in the United States using precast concrete panels to form double walls. The panels were erected in two rings, and then apparently supported circumferentially by wrapping post-tensioning cable around the exterior of each ring. The post-tensioning cable was then covered with sprayed concrete. The outside wall was completed by pouring concrete against the interior surface of the outside ring. In other contexts, steel liners have been used on concrete panels.

Conventionally, however, the walls for storage tanks are built by pouring the entire, full thickness of the wall. For a conventional 35-meter tall storage tank having a 160,000 cubic meter capacity, it may take a year or more to gather the materials for and build the wall for such a tank.

The time required for building the wall can be important. In many projects, the roof of a storage tank is assembled at ground level within the interior of the wall. Once assembled, the roof is raised by air pressure and secured in place above the wall. After it is has been raised and secured, the roof provides a protected interior environment that is often important for finishing the interior of the tank.

Providing a quicker way to provide a protected interior environment could allow the interior work to begin sooner. Because the interior work is often on the critical path of projects involving the construction of liquid storage tanks, speeding up the time when such work can begin can sometimes result in a significantly shortened schedule for such a project. In projects involving the construction of a regasification terminal, shortening the construction schedule by two months could reduce construction costs and increase value to the owner by approximately $10 million.

In addition to the general advantages of reduced schedule, reducing the time required to construct the wall provides a unique advantage in regions such as Alaska that have hostile climates and a limited construction season. If the wall can be built and the roof secured above the wall during a summer construction season, work can continue in the interior environment through the winter.

SUMMARY OF THE INVENTION

A new precast panel has been developed that can be used in building reinforced concrete walls such as those used liquid storage tanks. Using the panel to build the walls of a storage tank can enable a protected interior environment to be established quicker, significantly shortening the construction schedule. It also reduces the amount of formwork necessary for pouring the remainder of the wall.

The panel has a metal liner that forms a front surface of the panel. A concrete mass is disposed behind the metal liner. Unlike previously-known panels used in building walls for liquid storage tanks, the panel has reinforcement structure within the concrete mass that can be used to provide continuity of reinforcement between adjacent panels. The reinforcement structure may take the form of reinforcing bars that extend to vertical edges of the panel. The reinforcement structure can also include post-tensioning ducts through which tendons are strung after the panels are erected. Preferably, the liner, the reinforcement structure, and the concrete mass form a composite steel-concrete structure.

The panels also include shear structure that extends rearwardly through the concrete mass and projects outwardly from the rear surface of the concrete mass.

To build a wall using the panel, a second panel is aligned to a previously-erected panel so that so that an edge of the metal liner on the first panel is adjacent to a metal liner on the second panel. The adjacent edges of the metal liners are then connected, and continuity of reinforcement between the panels is provided using the reinforcement structure.

In one embodiment of the invention where reinforcing bars are used as the reinforcement structure, continuity of reinforcement can be provided by connecting a splice end on the reinforcing bar with a similar splice end on the other panel. The connection can be made more easily if one of the edges on the concrete mass is recessed inwardly from a corresponding edge of the metal liner. Alternatively, the continuity of reinforcement can be provided by extending post-tensioning through ducts in the panels.

Use of the new precast panel can permit the roof on a storage tank to be air-raised as soon as the panels are erected to the full height of the wall. Subsequently, concrete can be added behind the precast panels to cover the projecting shear structure and form the additional wall mass needed to support the tank when it is filled with liquid.

BRIEF DESCRIPTION OF THE DRAWINGS

The invention may be understood more clearly upon review of the accompanying drawings, in which.

DETAILED DESCRIPTION OF THE DRAWINGS

Figure 1:
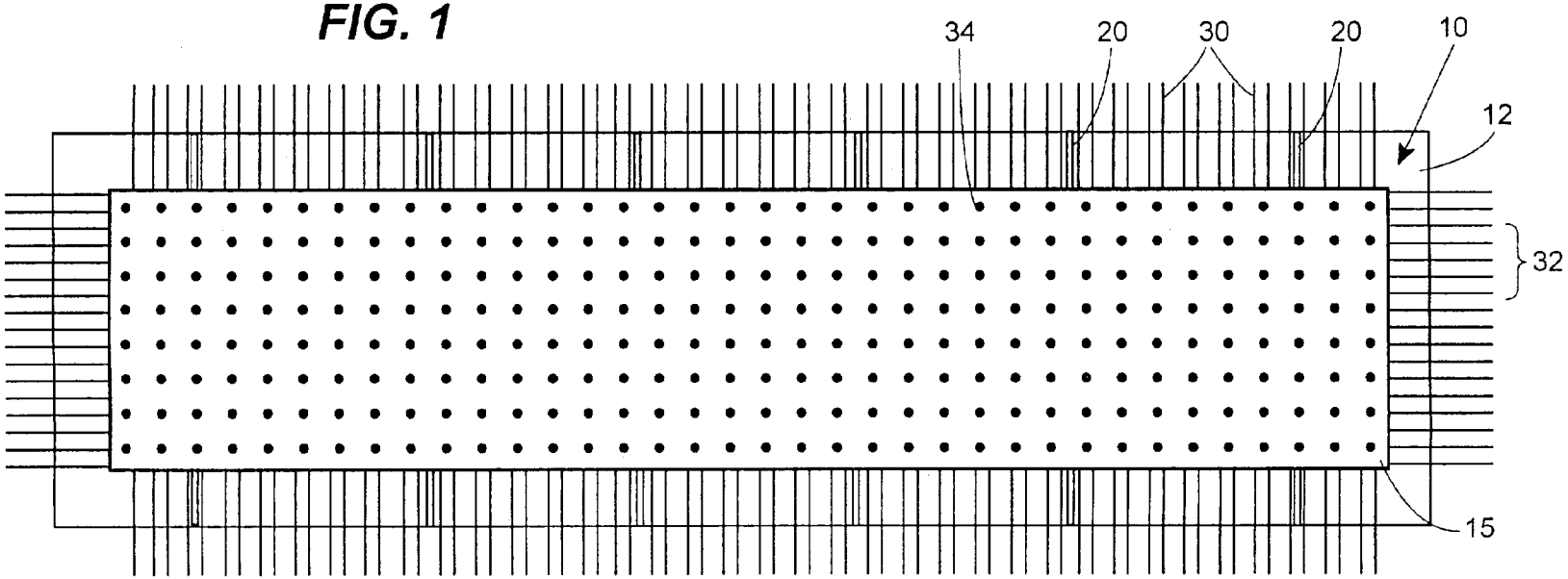
FIG. 1 is a rear view of a precast panel in accordance with one embodiment of the present invention.
Figure 2:
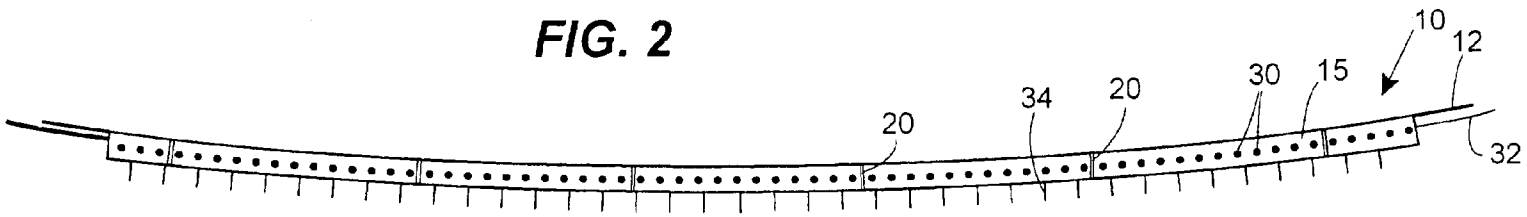
FIG. 2 is a plan view of the panel.

FIGS. 1 and 2 illustrate one example of a precast panel 10 that can be used to build reinforced concrete walls such as those used for liquid storage tanks. The illustrated panel is designed for use in building a tank having a capacity of 160,000 cubic meters and a 600 mm thick, 35½ m high containment wall. The panel measures approximately 12¾ meters wide by 3¾ meters high, is about 150 mm thick and has a versine of approximately 510 mm. The panel has a metal liner 12 that forms a front surface of the panel. It may be preferable if the panel weight does not exceed about 20 metric tons. The dimensions are not critical, and other arrangements could be used instead of those illustrated. Preferably, the panels are cast on or close to the jobsite.

The illustrated liner 12 is approximately 6 mm thick and has a yield stress of 345 MPa (50,000 psi). Preferably, the liner is thicker than merely gauge thickness, but not as thick as structural steel used to build free-standing roofed tanks. Generally, the liner should be between 5 and 15 mm thick. Liner sections that are 10 mm thick or more may have to be rolled. The liner on a panel may consist of multiple welded sheets, some of which are of different thicknesses. The liner may also be corrugated or have an otherwise bent shape.

A concrete mass 15 is disposed behind the metal liner. In the embodiment of the invention seen in FIG. 1, each edge of the concrete mass is recessed approximately 540 mm from a corresponding edge of the metal liner, and the mass is approximately 145 mm thick. Erection chairs 20 are spaced along the horizontal edges. The illustrated erection chairs consist of two 20 mm wide steel legs 22 that extend from the concrete mass to a position approximately 60 mm from the end of the liner 12. A seat 24 extends between the ends of the legs, and has a central bolt hole 26. Other arrangements can be used. The chairs can be attached either in the shop or in the field. In other embodiments of the invention, the concrete mass may extend all the way to one or more (or all) edges of the liner.

The concrete mass 15 can be poured after placing the liner 12 on a frame that can be built to the radius of the inside of the tank wall. Boards cut to the curvature of the panel can be used to define the edge of the concrete. Adhesive may be used to provide a shear-resisting bond between the liner and the concrete mass.

Unlike previously-known panels used in building walls for liquid storage tanks, the panel 10 contains a reinforcement structure within the concrete mass 15 that can be used to provide continuity of reinforcement between adjacent panels. The reinforcement structure may take the form of reinforcing bars that extend to and beyond vertical edges of the panel, as illustrated in FIGS. 1 and 2. In those figures, vertical reinforcing bars 30 and horizontal reinforcing bars 32 are made of 20 mm diameter steel bars, and are spaced approximately 150 mm apart. The bars are disposed near the middle of the thickness of the panel, with the horizontal bars behind the vertical bars. The bars extend approximately 525 mm beyond the edges of the liner 12. These sizes and dimensions were selected to support the weight of the panels, a roof weight of approximately 95 kg/m$^2$, an internal pressure of about 1.9 kN/m$^2$ for raising the roof by air pressure, a wind load, the possibility of a live snow load on the roof, and a load from the pouring of concrete to complete the wall. The sizes and arrangement may vary for other needs, and are not critical to achieving benefits from the invention.

The panel may also contain prestress tendons or rods. Unlike previously-known panels, the panel 10 can be used where post-tensioning tendons or rods will be included within the cast-in-place concrete of the completed wall.

Preferably, the liner 12, the reinforcement structure, and the concrete mass 15 form a composite steel-concrete structure, meaning that the concrete and the steel are interconnected so as to respond to load as a unit. Preferably, the composite panel meets all pertinent official standards for structural design. Currently, the American Institute of Steel Construction (AISC) Design Specification for Structural Steel Buildings requires (at chap. I1) that composite beams include enough shear connectors "to develop the maximum flexural strength of the composite beam." The AISC specification also provides (at chap. I2) that the cross-sectional area of the steel shape, pipe or tubing shall comprise at least four percent of the total composite cross section. While not necessary to the invention, these standards are met in the illustrated panel.

Figure 3:
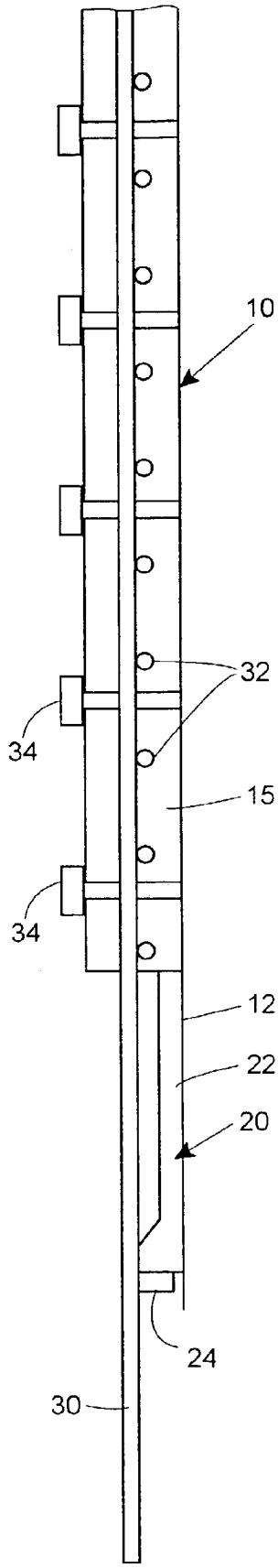
FIG. 3 is a fragmentary, enlarged sectional view through section 3—3 of FIG. 2.

The illustrated panels 10 also include shear structure that is connected to the metal liner 12, extends rearwardly through the concrete mass 15, and projects outwardly from the rear surface of the concrete mass. In the panel seen in FIG. 3, the shear structure is in the form of a 200 mm long shear studs 34 that are mounted to the liner by welding. The illustrated shear studs are spaced 300 mm apart. Other types and arrangements of shear structure could be used. For example, reinforcing bars may be welded to the liner, and/or structural shapes such as channels, wide flange sections, or angles may be welded to the liner.

Figure 4:
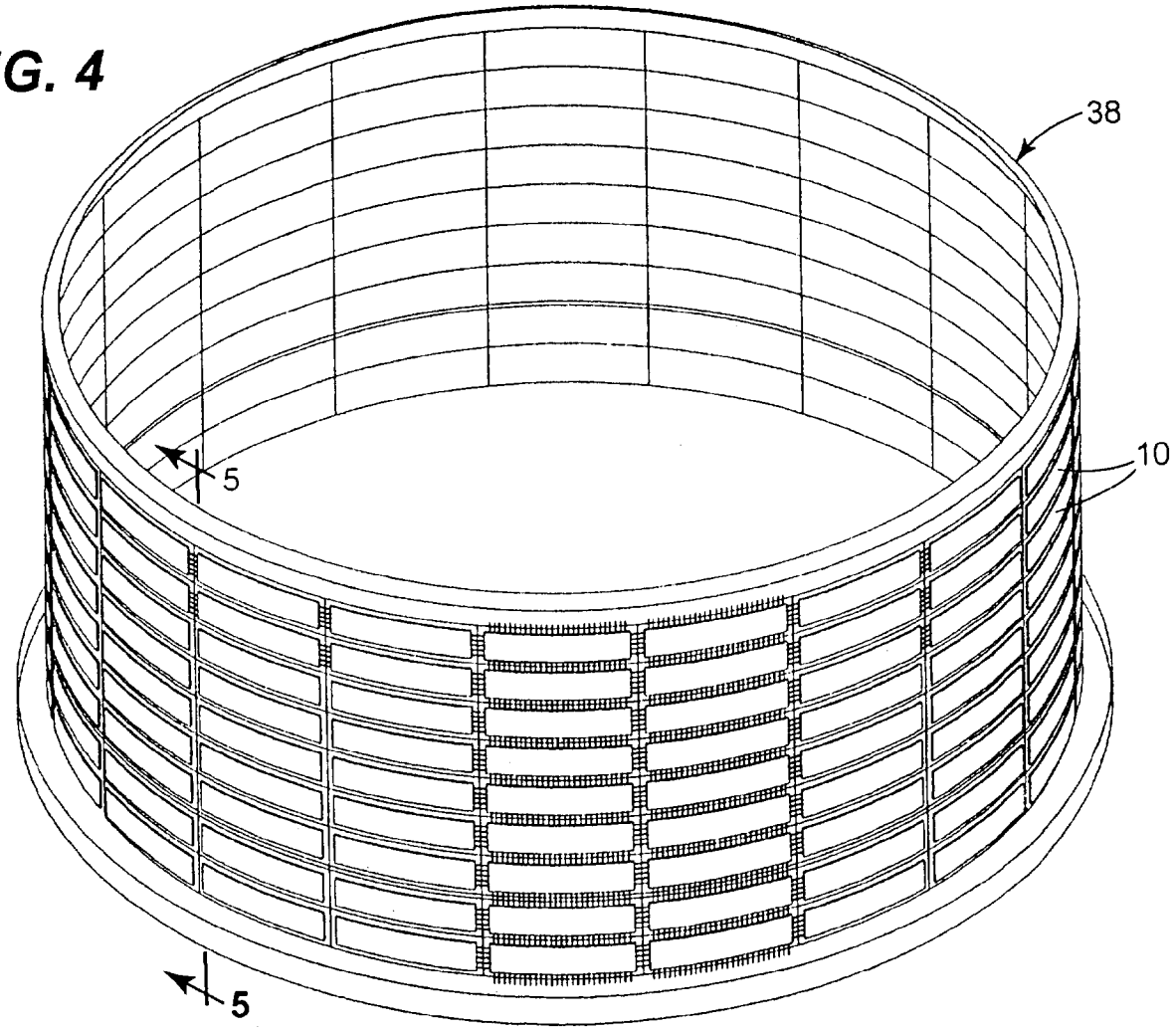
FIG. 4 is an isometric view of a wall shell built using the panels of FIG. 1.
Figure 5:
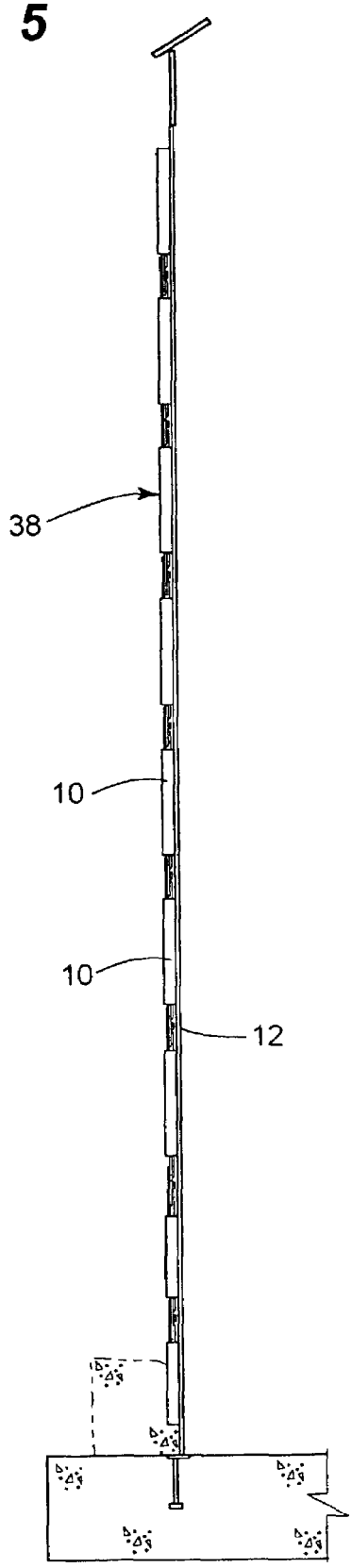
FIG. 5 is a sectional view through section 5—5 of FIG. 4.

To build a wall using the panel, the panels are first connected to make a wall shell 38 like the one seen in FIGS. 4 and 5. The illustrated panels 10 are configured for horizontal orientation. A horizontal configuration may permit the initial course of panels to be completed more quickly, allowing initial assembly of the roof (prior to its being raised) to begin sooner. The horizontal configuration may also be more stable during erection. Comparable panels could also be configured for vertical orientation.

Figure 6:
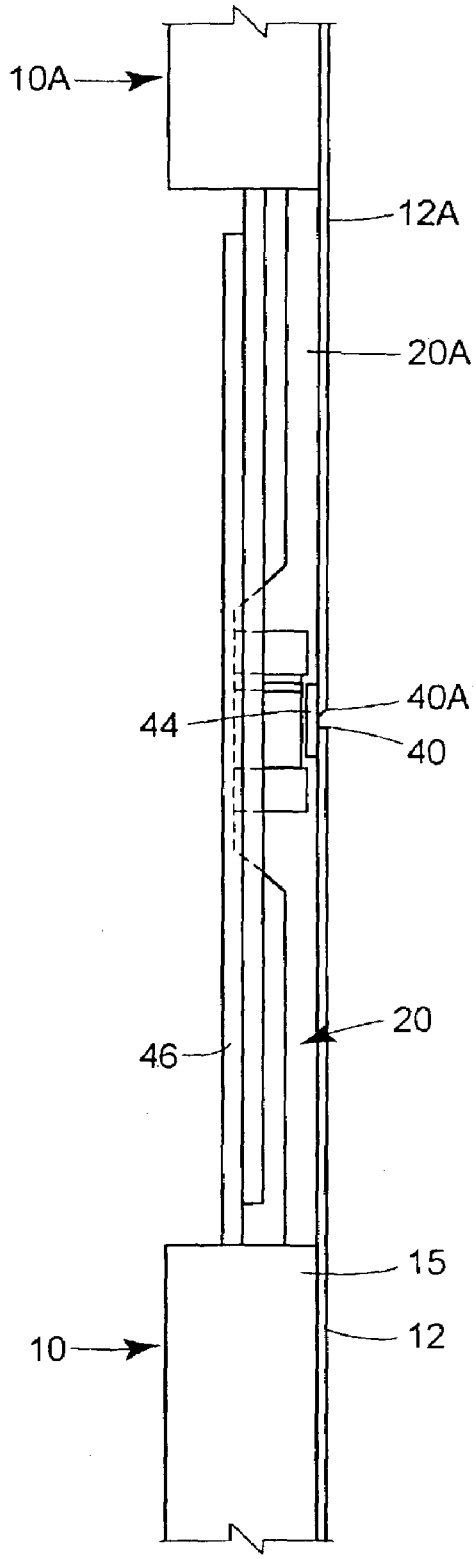
FIG. 6 is a fragmentary sectional view of one possible joint between two courses of the panels seen in FIG. 1.
Figure 7:
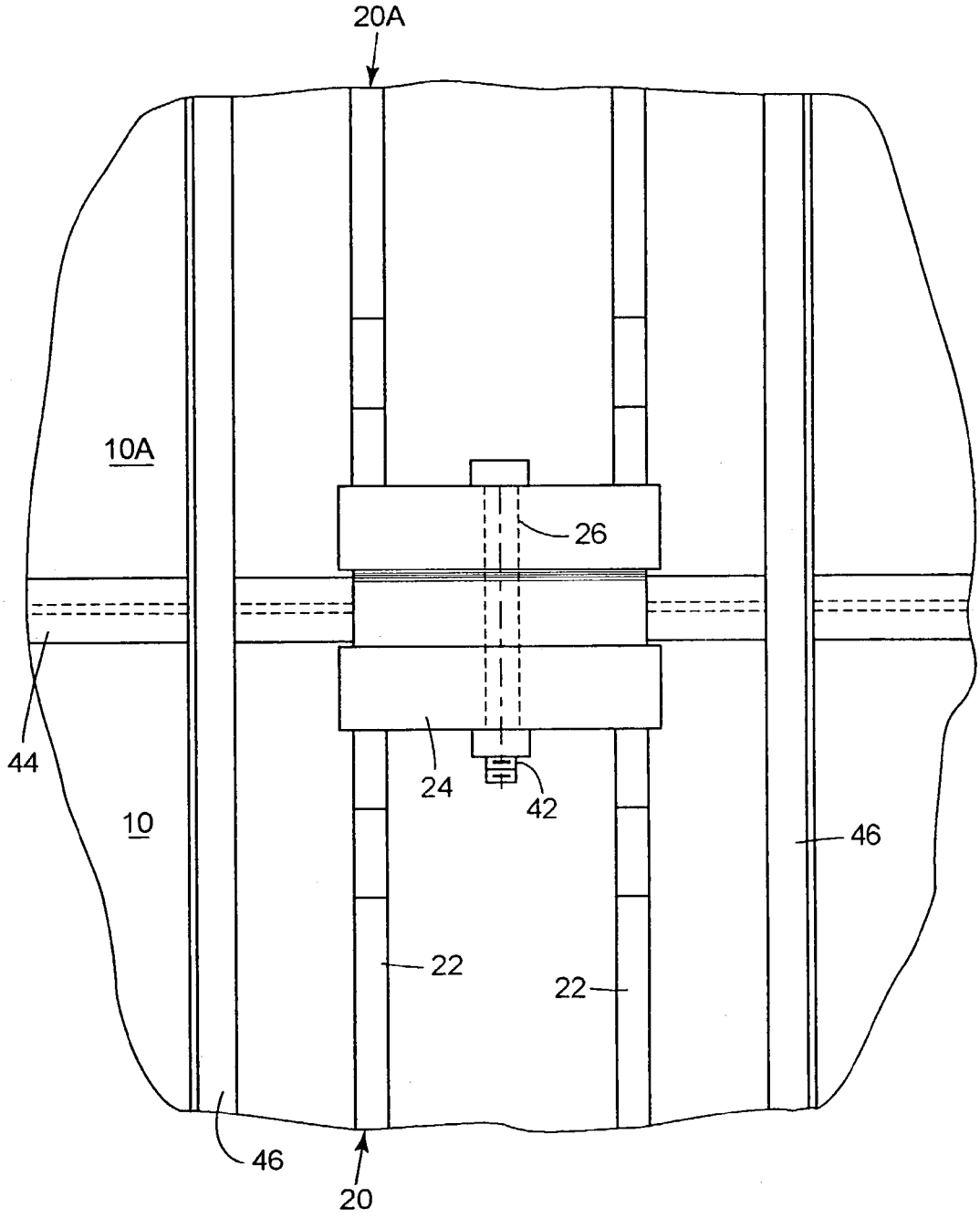
FIG. 7 is a fragmentary front view of the joint seen in FIG. 6.

To build the wall shell 38, conventional fitting and welding techniques may be used. In FIGS. 6 and 7, a second panel 110A is aligned with a previously-erected panel 10 so that an edge 40 of the metal liner 12 on the first panel is adjacent an edge of a metal liner 12A on the second panel. A 150-ton crane can be used to lift the illustrated panels. Corresponding erection chairs 20, 20A are aligned and shimmed, and then joined by a bolt 42. The vertical seams may be fit using conventional tank and vessel erection equipment. The adjacent edges 40, 40A of the metal liners can be connected by welding. It may be advantageous to do such welding after all the panels in the ring have been erected. A backing bar 44 can be provided behind the adjoining edges of the liners, but other types of possible connections may be apparent to those skilled in the art.

Continuity of reinforcement between the panels is provided using the reinforcement structure within the panels. FIG. 6 illustrates an example of providing continuity of reinforcement of the panels 10 illustrated in FIG. 1. In that example, continuity of reinforcement is provided by connecting a splice end 46 on the vertical bar 30 with a similar splice end 46A on the other panel 10A. In that figure, the splice ends on each of the two panels are long enough to overlap each other. The recesses in the concrete masses 15, 15A on each panel leave a working space that enables a worker to tie the overlapping ends together. It may not be necessary for each concrete mass to be recessed. However, if the concrete mass on one panel extends all the way to the corresponding edge 40 of the metal liner 12 and the panel has a splice end that is to be connected to a splice end on an adjacent panel, then it would be preferred that the adjacent panel have a recessed edge. This is not necessary if adjacent panels are to be match cast and continuity of enforcement is to be provided in some other way, as discussed next.

Figure 14:
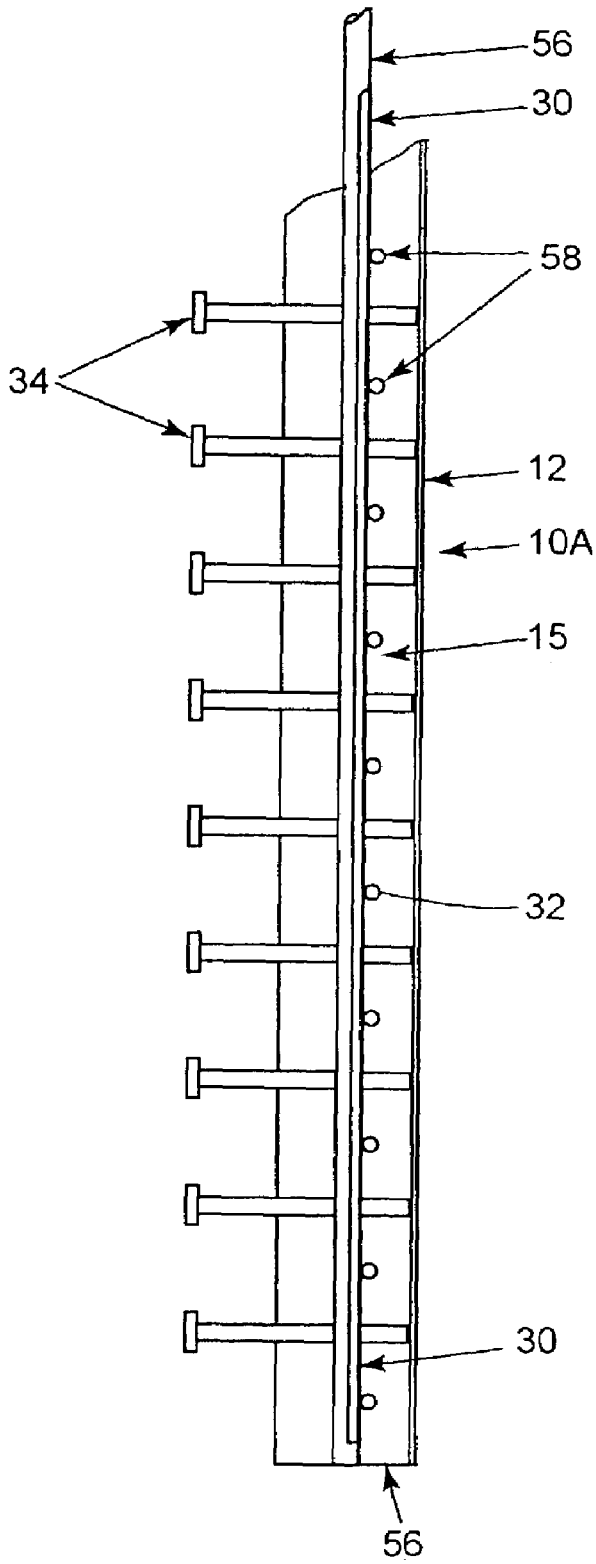
Figure 15:
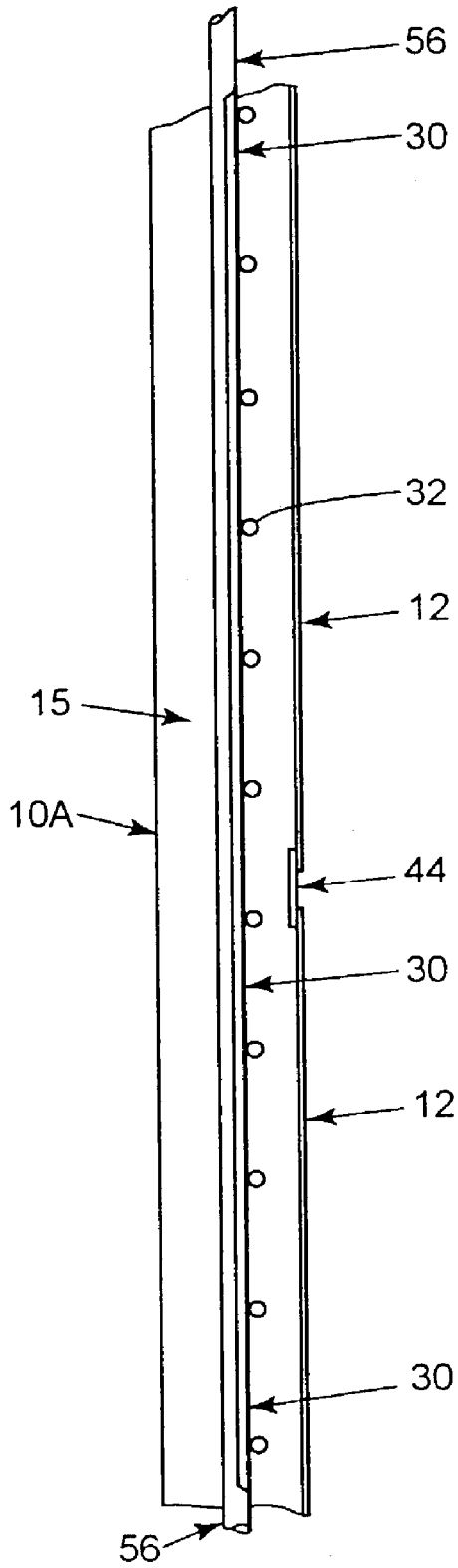

The reinforcement structure can alternatively include post-tensioning ducts. In such an embodiment, extending post-tensioning tendons through ducts in the panels could provide structural continuity of the panel assembly. An example of such an embodiment is shown in FIGS. 13–15.

Figure 13:
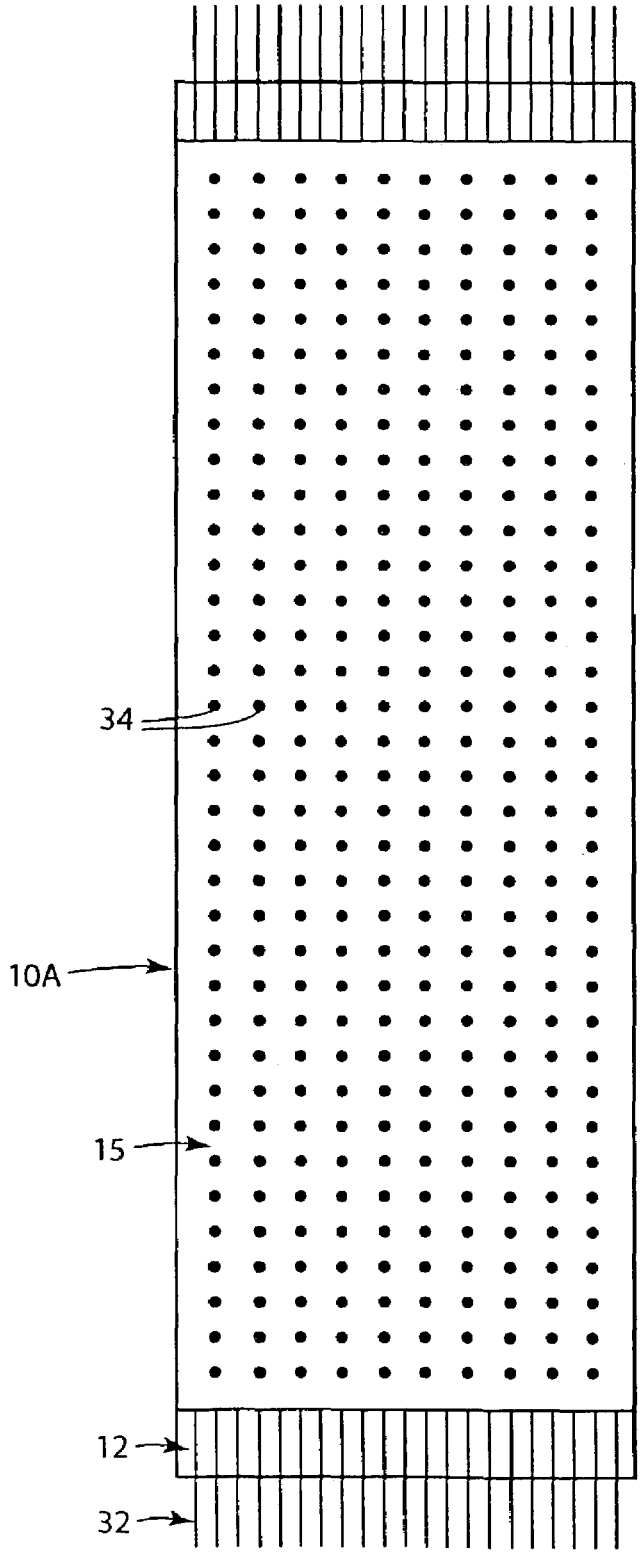

In FIG. 13, the illustrated embodiment, the horizontal edges of the panel 10A are match cast. Vertical tendon ducts 56 and horizontal tendon ducts 58 are seen in FIG. 14. FIG. 15 shows adjacent panels that have been joined at their match-cast edges with epoxy adhesive, leaving the vertical tendon ducts aligned.

Figure 8:
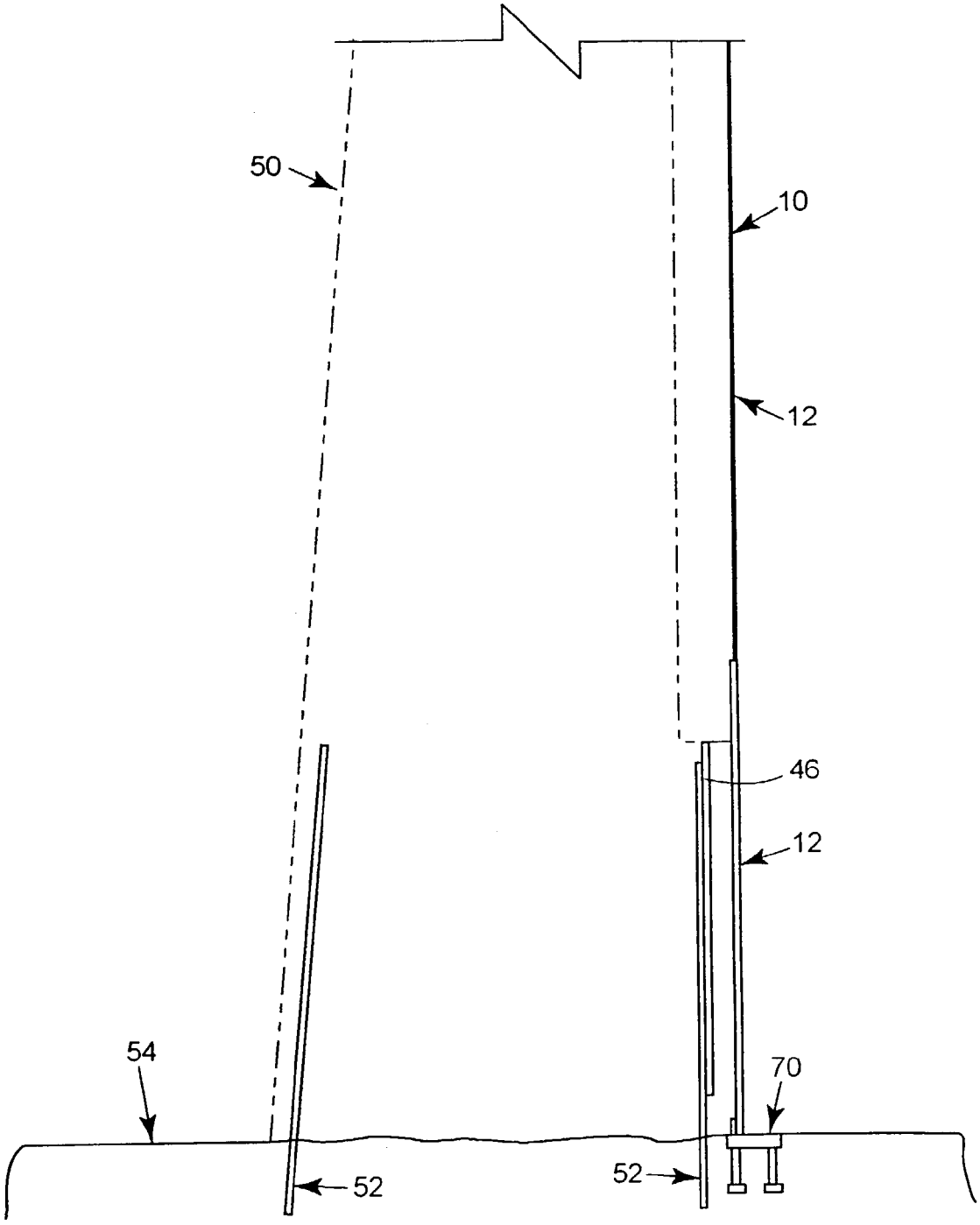
FIGS. 8–10 are fragmentary sectional views of three possible joints between a course of panels and a foundation.
Figure 9:
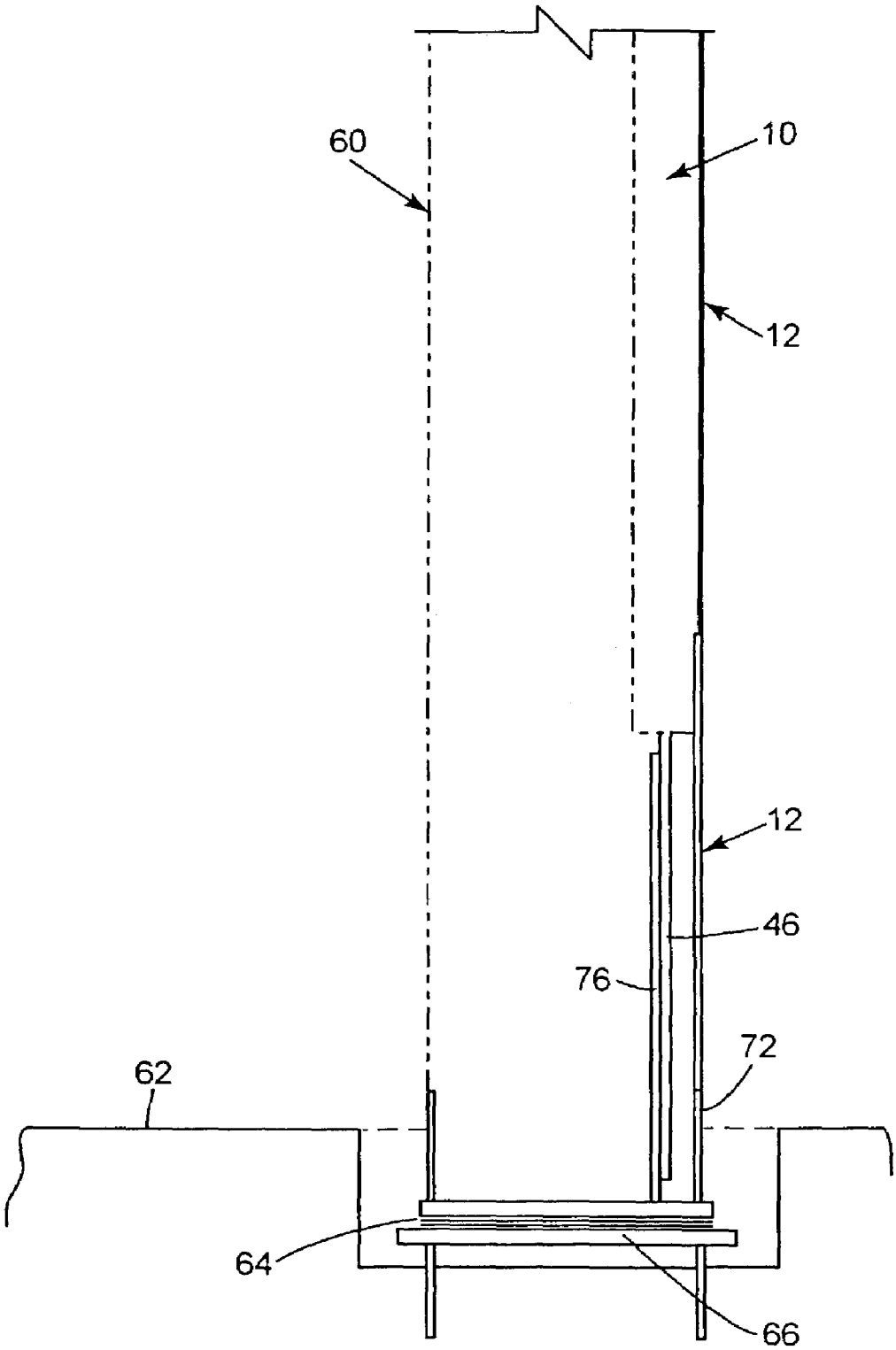
Figure 10:
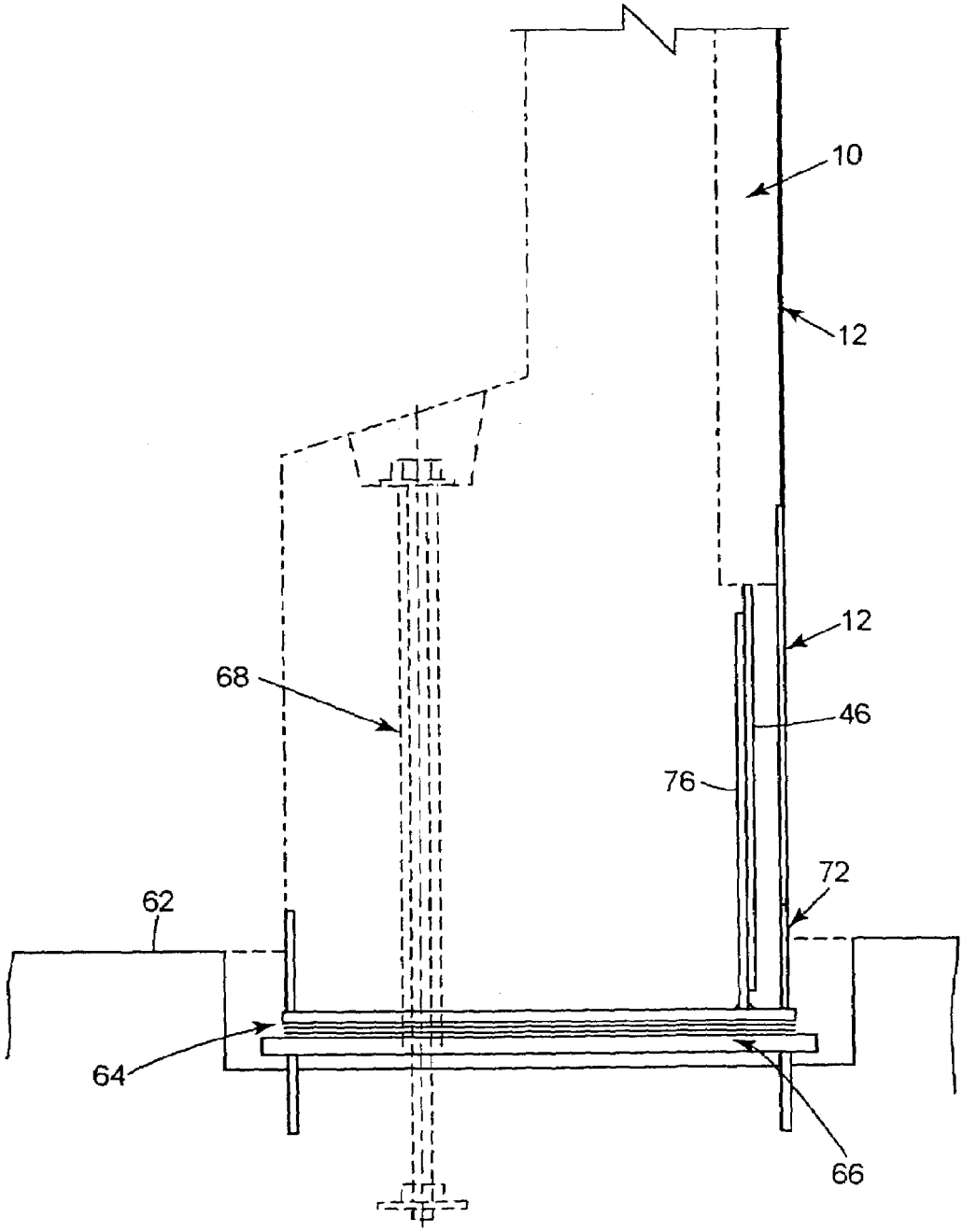

FIGS. 8–10 show different options for connecting the panels to a foundation. FIG. 8 shows a monolithic wall 50 with reinforcement 52 that is embedded both in the wall and in the foundation 54. The base of the wall is approximately 1200 mm thick, tapering to 600 mm over a height of about 7½ m. The splice ends 46 of the lowermost panel 10 are tied to the innermost reinforcement.

FIGS. 9 and 10 show sliding-pinned walls 60 connected to a foundation 62. In such arrangements, the wall-to-wall foundation joint is allowed to slide on a slide sheet 64 above a base plate 66 until after the circumferential post-tensioning tendons are stressed. In FIG. 10, the wall includes an anchorage 68 to resist uplift forces such as those that arise from internal pressure, wind, or earthquakes. In all these connections, the liner 12 on the panel 10 is 15 mm thick at the bottom of the panel. In FIG. 8, the liner is connected to an embedded plate 70 in the foundation 54. In FIGS. 9 and 10, the liner 12 is connected to a sliding joint tub assembly 72 that slides on the slide sheet 64. The splice end 46 of the lowermost panel 10 is connected to a reinforcement bar 76 that is welded to the slide sheet.

Figure 11:
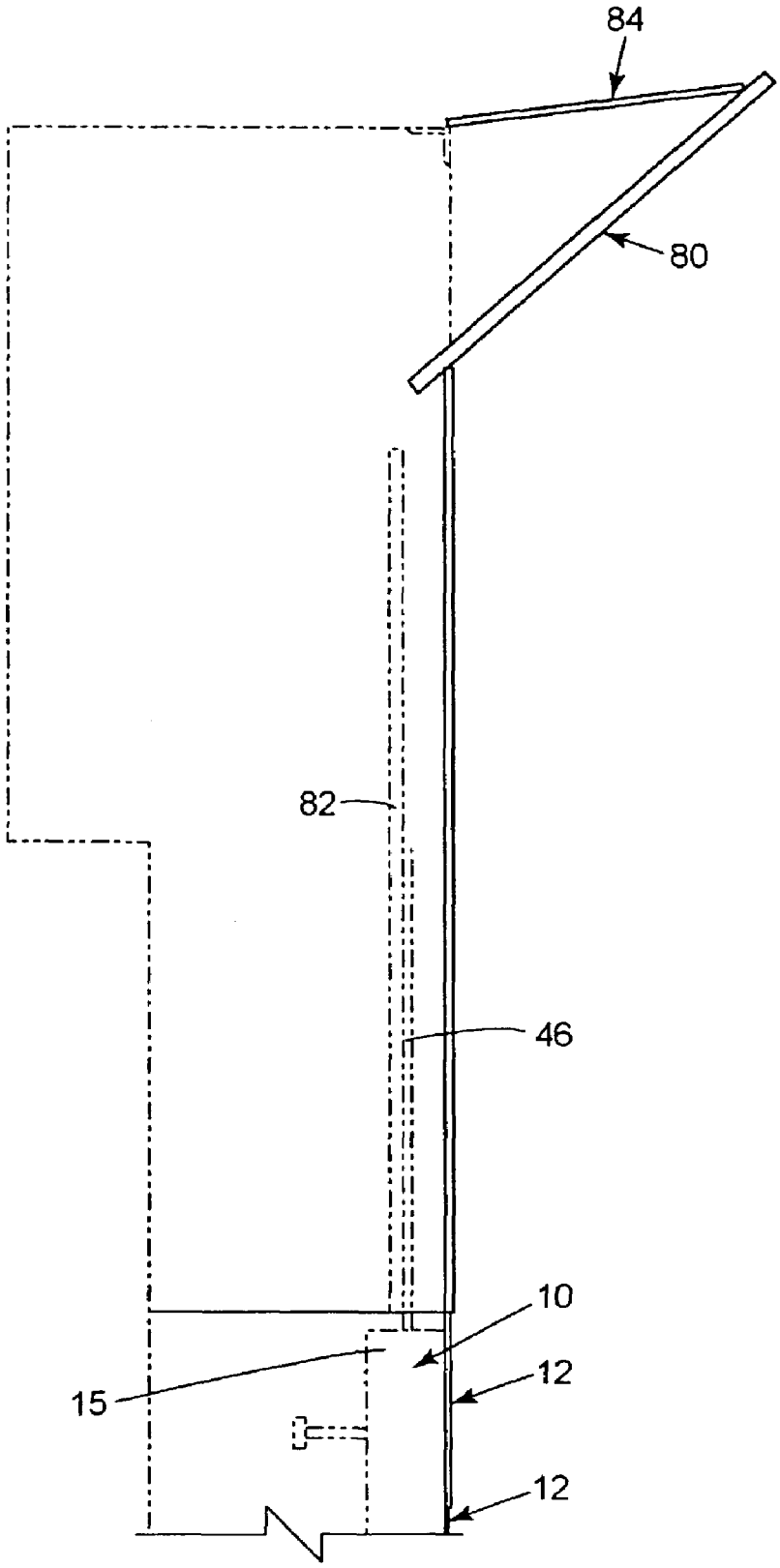
FIG. 11 is a fragmentary sectional view of a possible joint between a course of panels and a roof.

FIG. 11 shows an option for connecting the roof. Fixed roofs for storage tanks conventionally include a tension/compression bar 80. In the illustrated embodiment of the invention, the liner 12 on the top of the uppermost course of panels 10 is approximately 11 mm thick, and forms a base for attaching the tension/compression bar. The roof of a fixed roof tank of this type often weighs around 95 kg/m$^2$, and the thickness of the liner is sufficient to support this load. Additional reinforcement 82 can be tied to the splice end 46 to reinforce the concrete 83 that is poured later to complete the wall. After the wall is completed, a weather shield 84 may be added.

Use of the new precast panel 10 can permit the roof on a storage tank to be air-raised as soon as the panels are erected to the full height of the wall. In the illustrated arrangement, assembly of the roof can begin by the time the work on the third ring of panels 10 commences. Raising the roof often requires pressure of around 2 kN/m2. By forming a composite structure, the liner 12, the concrete mass 15, and the reinforcement structure within the concrete mass of the illustrated panels provides sufficient strength to support the roof. Subsequently, concrete can be added behind the precast panels to cover the projecting shear structure and form the additional wall mass needed to support the tank when filled with liquid.

Figure 12:
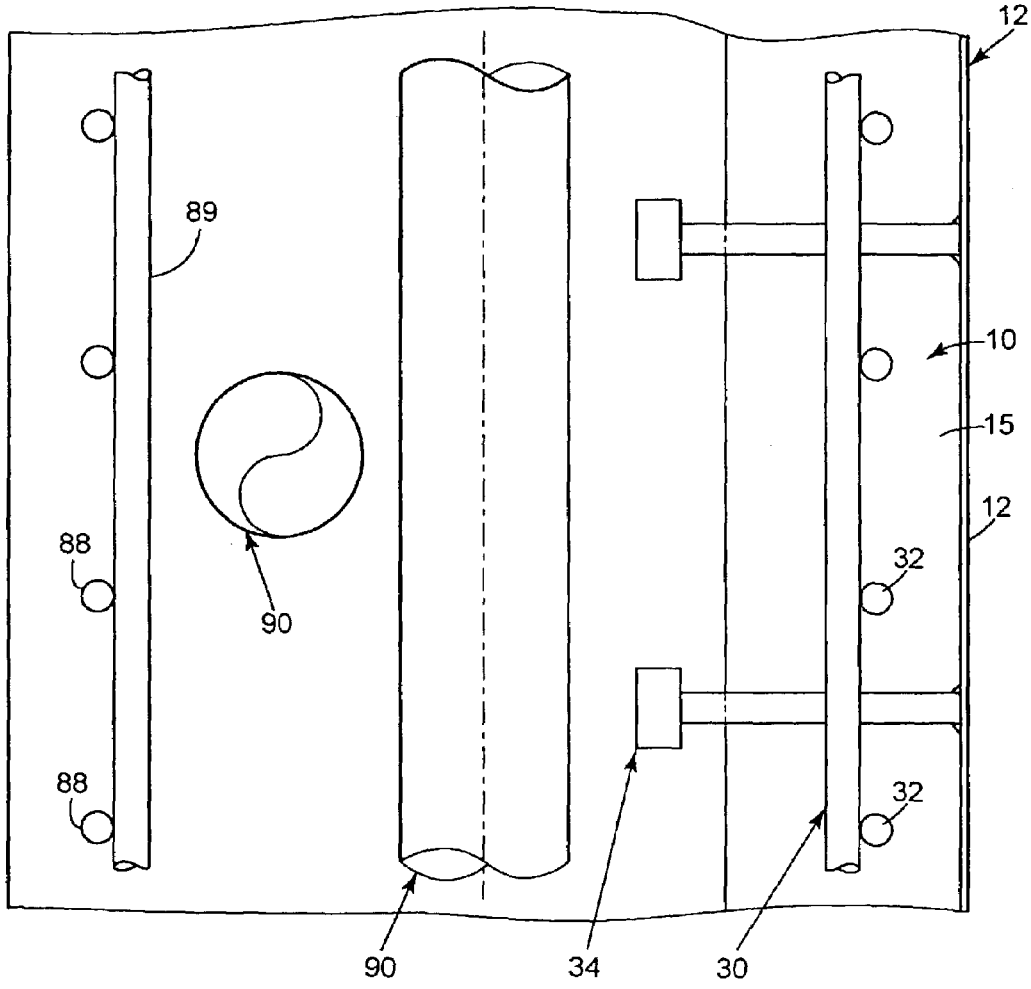
FIG. 12 is a fragmentary, cross-sectional view of a completed wall built using the panels of FIG. 1, and FIGS. 13–15 are views of an alternative embodiment, the views corresponding with FIGS. 1, 3, and 6, respectively.

After the wall shell 38 is completed, any necessary additional reinforcement, horizontal, vertical post-tensioning, or tendons or rods are added behind the panels. Concrete can then be poured to complete the wall. In FIG. 12, the additional reinforcement includes 20 mm circumferential bars 88 and verticals bars 89 and 105 mm circumferential and vertical post-tensioning ducts 90. The illustrated bars are spaced 150 mm apart approximately 500 mm from the outside surface of the wall, and the ducts are positioned between the bars and the ends of the shear studs 34 that extend from the concrete mass 15 of the panel 10. The poured concrete embeds the shear studs, functionally tying the poured concrete to the panels. Other kinds of shear structure could also be used. Adhesive may also be used to provide a shear-resisting bond between the concrete mass and the additional wall mass.

Other modifications should be apparent to those skilled in the art. This detailed description has been given for clarity of understanding only. It is not intended and should not be construed as limiting the scope of the invention, which is defined in the following claims.

What is claimed is:

1. A method for building a wall, the method comprising the steps of:

erecting a precast panel that has a metal liner that forms a front surface of the panel, a concrete mass that is disposed behind the metal liner and has exposed lateral sides, reinforcement structure that extends laterally through the concrete mass and exits the mass through the exposed lateral sides, and shear structure that extends rearwardly through the concrete mass and projects outwardly from the rear surface of the concrete mass;

aligning a subsequent panel with the previously-erected precast panel so that an edge of the metal liner on the previously-erected panel is adjacent a metal liner on the subsequent panel;

connecting the adjacent edges of the metal liners;

using the reinforcement structure to provide continuity of reinforcement between the panels; and adding concrete behind the precast panels to cover the projecting shear structure and form an additional wall mass.

2. A method as recited in claim 1, in which:

the concrete mass has at least one recessed edge that is recessed inwardly from a corresponding edge of the metal liner;

the reinforcement structure comprises at least one reinforcing bar that has a splice end that projects beyond the recessed edge of the concrete mass; and the continuity of reinforcement is provided by connecting the splice end with a splice end on the second panel.

3. A method as recited in claim 1, in which:

the concrete mass has at least one recessed edge that is recessed inwardly from a corresponding edge of the metal liner;

the reinforcement structure comprises at least one duct that exits the concrete mass at an exposed concrete edge; and the continuity of reinforcement is provided by extending post-tensioning through the duct to a corresponding duct in the second panel.

4. A method as recited in claim 1, in which the added concrete forms an outside face of the completed wall.

5. A method as recited in claim 1, in which adhesive is used to provide a shear-resisting bond between the concrete mass and the additional wall mass.

* * * * *

UNITED STATES PATENT AND TRADEMARK OFFICE

CERTIFICATE OF CORRECTION

PATENT NO. : 7,162,844 B2
APPLICATION NO. : 10/339098
DATED : January 16, 2007
INVENTOR(S) : Donald M. Morrison It is certified that error appears in the above-identified patent and that said Letters Patent is hereby corrected as shown below:

On the Title Page:

At item (75), 3rd named Inventor, "David Roger Butts" should be -- Roger David Butts --.

Signed and Sealed this

Twenty-first Day of August, 2007

JON W. DUDAS
*Director of the United States Patent and Trademark Office*